US008214940B2

(12) United States Patent
Jensen

(10) Patent No.: US 8,214,940 B2
(45) Date of Patent: Jul. 10, 2012

(54) QUICK SINK

(76) Inventor: Craig Jensen, Salt Lake City, UT (US)

( * ) Notice: Subject to any disclaimer, the term of this patent is extended or adjusted under 35 U.S.C. 154(b) by 68 days.

(21) Appl. No.: 12/860,664

(22) Filed: Aug. 20, 2010

(65) Prior Publication Data

US 2012/0042446 A1 Feb. 23, 2012

(51) Int. Cl.
*E03C 1/01* (2006.01)

(52) U.S. Cl. ..... 4/670

(58) Field of Classification Search ..... 4/670–678
See application file for complete search history.

(56) References Cited

U.S. PATENT DOCUMENTS 2,653,357 A * 9/1953 Sanders et al. ..... 4/670
3,623,166 A * 11/1971 Wilkinson ..... 4/670
5,987,659 A * 11/1999 Cannizzaro ..... 4/420.2
2003/0019031 A1* 1/2003 Mosis ..... 4/625

* cited by examiner

*Primary Examiner* — Lori Baker
(74) *Attorney, Agent, or Firm* — DLC Patents, PLLC; Dustin L. Call

(57) ABSTRACT

One example embodiment includes a quick sink system. The quick sink system includes a sink. The sink includes a faucet, where the faucet includes a cold water input for receiving cold water and a hot water input for receiving hot water. The sink also includes a basin, where the basin is configured to retain water and a drain, where the drain is configured to remove water from the basin. The quick sink system also includes a first connector, where the first connector is configured to connect the cold water input to a cold water supply, and a second connector, where the second connector is configured to connect the hot water input to a hot water supply.

19 Claims, 5 Drawing Sheets

QUICK SINK

CROSS-REFERENCE TO RELATED APPLICATIONS

Not applicable.

BACKGROUND OF THE INVENTION

Installation of plumbing can be both laborious and expensive. This is especially true when the plumbing is installed after the walls and other elements of the room have been finished. In that case, to install the appropriate plumbing, drywall will need to be removed, the appropriate plumbing installed, drywall replaced and the drywall textured/painted to match existing drywall. Additionally, flooring may need to be removed to install drains for the newly installed plumbing.

Many homeowners, nevertheless, continue to incur this expense when they want to add additional plumbing to their home. For example, many homeowners would like to add a sink in a laundry room, outdoors or other locations. Many homeowners endure the time and cost to have the plumbing that they desire installed.

Nevertheless, in many instances there is already an available water supply that exists near where the homeowner desires additional plumbing fixtures. For example, laundry rooms include both cold and hot water supplies that are hooked to the washing machine. The inconvenience, however, of unhooking the washing machine to hook up the sink when the sink is needed is something that most homeowners are willing to endure.

Additionally, many of these same locations include existing drainage. For example, a washing machine pumps waste water into a drain located either in the floor or inside a nearby wall. However, this drainage is often difficult for a sink to naturally drain to or even access. For example, the drain may be located directly behind or underneath the washing machine. Therefore, an ordinary sink cannot use gravity to drain as most sinks do.

In addition, if the homeowner decides to install the plumbing, it is difficult or impossible to later move. For example, swapping the location of a sink and a washing machine in a laundry room would mean that the plumbing fixtures and possibly even the drains would need to be removed.

Finally, even if the homeowner does incur the expense to install water supplies and drainage, the plumbing becomes part of the home. That is, the homeowner can incur significant expense for a plumbing fixture that a short time later they are unable to take advantage of due to a move or other circumstances.

Accordingly, there is a need in the art for a sink that can be installed using existing plumbing including water supplies and drains that are already installed. Additionally, there is a need in the art for a sink that can be easily moved. In addition, there is a need in the art for a sink that can be removed and taken with the homeowner if the homeowner moves.

BRIEF SUMMARY OF SOME EXAMPLE EMBODIMENTS

This Summary is provided to introduce a selection of concepts in a simplified form that are further described below in the Detailed Description. This Summary is not intended to identify key features or essential characteristics of the claimed subject matter, nor is it intended to be used as an aid in determining the scope of the claimed subject matter.

One example embodiment includes a quick sink system. The quick sink system includes a sink. The sink includes a faucet, where the faucet includes a cold water input for receiving cold water and a hot water input for receiving hot water. The sink also includes a basin, where the basin is configured to retain water and a drain, where the drain is configured to remove water from the basin. The quick sink system also includes a first connector, where the first connector is configured to connect the cold water input to a cold water supply, and a second connector, where the second connector is configured to connect the hot water input to a hot water supply.

Another example embodiment includes a method for producing a quick sink system. The method includes providing a sink. The sink includes a faucet, where the faucet includes a cold water input for receiving cold water and a hot water input for receiving hot water. The sink also includes a basin, where the basin is configured to retain water, and a drain, where the drain is configured to remove water from the basin. The method also includes providing a first connector, where the first connector is configured to connect the cold water input to a cold water supply, and providing a second connector, where the second connector is configured to connect the hot water input to a hot water supply.

Another example embodiment includes a quick sink system, where the quick sink system is configured to allow for the installation of a sink using existing plumbing connections connected to a washing machine. The quick sink system includes a sink, where the sink includes a faucet. The faucet includes a cold water input for receiving cold water and a hot water input for receiving hot water. The quick sink system also includes a basin, where the basin is configured to retain water, and a drain, where the drain is configured to remove water from the basin. The quick sink system also includes a first connector, where the first connector is configured to connect a cold water supply to the cold water input and to a cold water connector in a washing machine, and a second connector, where the second connector is configured to connect a hot water supply to the hot water input and to a hot water connector in the washing machine. The quick sink system also includes a pump, where the pump is configured to pump water from the drain to a wall drain used by the washing machine, and a housing, where the housing is configured to substantially enclose a portion of the basin, the drain, a portion of the first connector, a portion of the second connector and the pump.

These and other objects and features of the present invention will become more fully apparent from the following description and appended claims, or may be learned by the practice of the invention as set forth hereinafter.

BRIEF DESCRIPTION OF THE DRAWINGS

To further clarify various aspects of some example embodiments of the present invention, a more particular description of the invention will be rendered by reference to specific embodiments thereof which are illustrated in the appended drawings. It is appreciated that these drawings depict only illustrated embodiments of the invention and are therefore not to be considered limiting of its scope. The invention will be described and explained with additional specificity and detail through the use of the accompanying drawings in which.

DETAILED DESCRIPTION OF SOME EXAMPLE EMBODIMENTS

Reference will now be made to the figures wherein like structures will be provided with like reference designations. It is understood that the figures are diagrammatic and schematic representations of some embodiments of the invention, and are not limiting of the present invention, nor are they necessarily drawn to scale.

Figure 1:
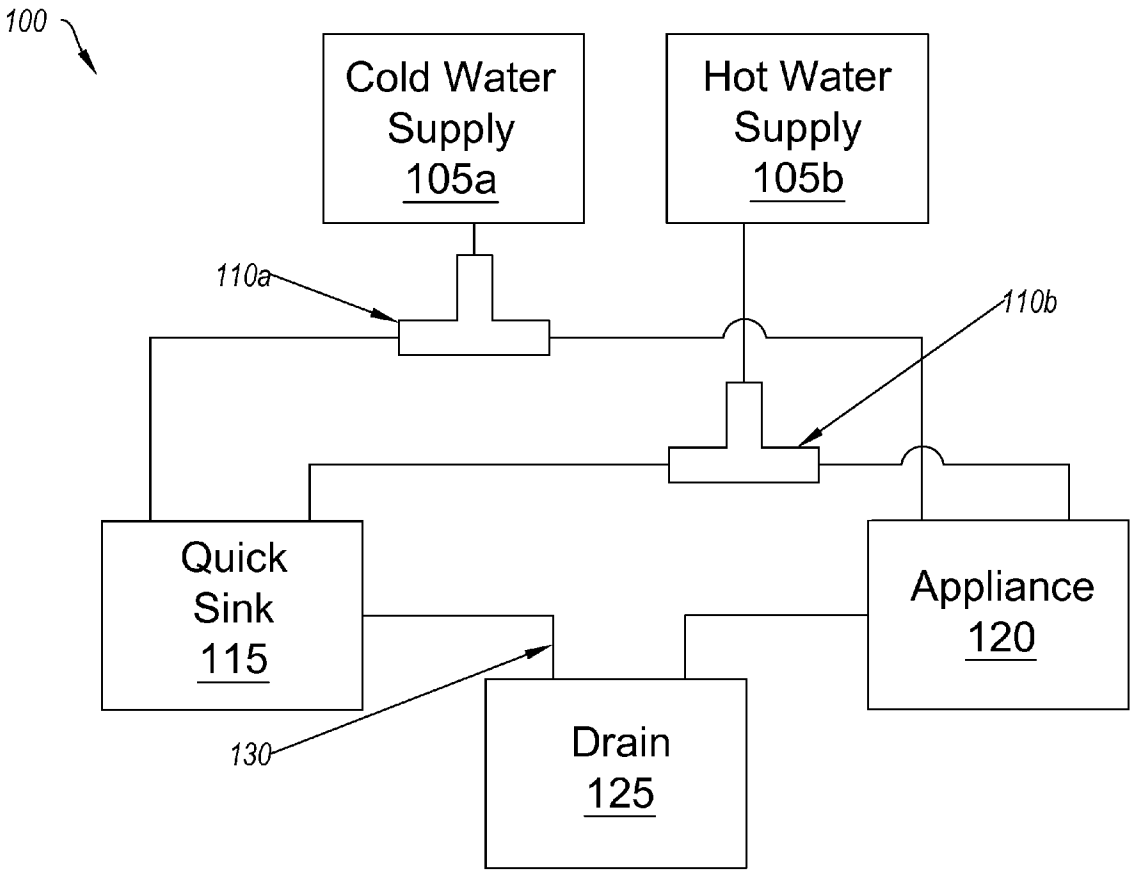
FIG. 1 illustrates a block diagram of a system for connecting a sink to existing plumbing.

FIG. 1 illustrates a block diagram of a system 100 for connecting a sink to existing plumbing. For example, the system 100 can use a single set of water supplies for the installation of a sink sharing the water supply of an existing appliance. In at least one implementation, the installation can take advantage of existing plumbing fixtures for the installation of a sink.

FIG. 1 shows that the system 100 includes a cold water supply 105*a* and a hot water supply 105*b* (collectively "water supplies 105"). In at least one implementation, the cold water supply 105*a* and the hot water supply 105*b* are existing water supplies. The water supplies 105 can be previously installed for use with an appliance.

In at least one implementation, the water supplies 105 can include plumbing fixtures, such as a hose bib (or bibb). In particular, a hose bib can include a threaded faucet also known as a wall hydrant. I.e., the spout includes a threaded end that is configured to be connected to a hose. A hose bib can include a single valve stem directly before the spout. The hose bib can be installed recessed within a wall or can be located nearer the interior of a room.

FIG. 1 also shows that the system 100 includes a first connector 110*a* and a second connector 110*b* (collectively "connectors 110"). In at least one implementation, the connectors 110 can include hoses for connecting the water supplies 105 to a quick sink 115 and to an appliance 120, as described below. Additionally or alternatively, the connectors 110 can be configured to connect to hoses that are connected as needed.

FIG. 1 further shows that the system 100 includes a quick sink 115. In at least one implementation, a quick sink 115 is a system that can be connected to an existing water supply and existing drain system, as described below. In particular, the quick sink 115 is configured for installation where the area has been plumbed for a different use. I.e., the quick sink 115 can be installed in an area that would require extensive plumbing changes for installation of a standard sink.

FIG. 1 also shows that the system 100 includes an appliance 120. In at least one implementation, the appliance 120 can be any appliance that includes connections to an existing water supply, next to which the quick sink 115 will be installed. For example, the appliance 120 can include an existing sink. Additionally or alternatively, the appliance 120 can include a washing machine. A washing machine, also called a clothes washer or washer, is a machine designed to wash laundry, such as clothing, towels and sheets using water as the primary cleaning solution. A washing machine agitates the laundry in order to flex the cloth to break apart solids and help the soap penetrate.

FIG. 1 further shows that the system 100 includes a drain 125. A drain is the primary vessel for unwanted water to be flumed away, either to a more useful area, funneled into a receptacle, or run into the sewers or septic system as waste. In at least one implementation, the drain 125 includes an existing drain 125 for removing waste water from the appliance 120. A hose 130 can be used to connect the quick sink 115 to the drain 125 for the removal of waste water from the quick sink, as described below.

Figure 2:
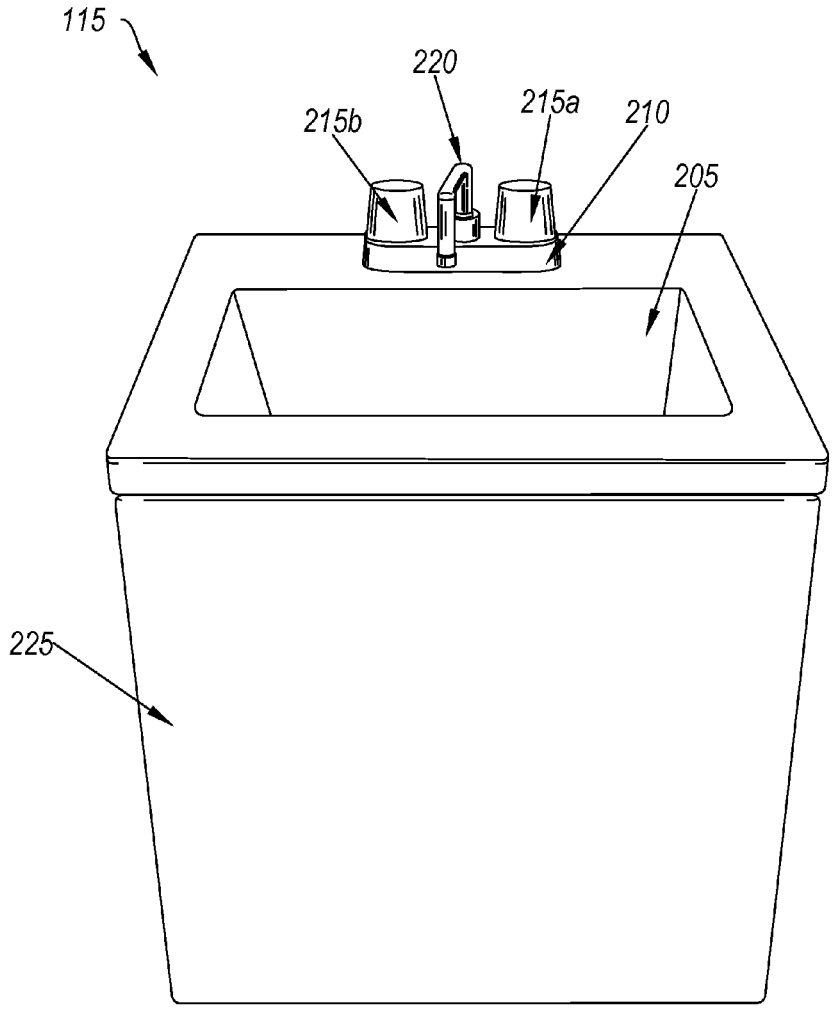
FIG. 2 illustrates an example of a quick sink.

FIG. 2 illustrates an example of a quick sink 115. In at least one implementation, the quick sink 115 is configured to include all of the parts necessary for installation before being delivered to the installation site. In particular, the quick sink 115 can be a complete unit, that can be delivered to the installation site and installed without the need for renovating the existing plumbing and without the need for additional parts.

FIG. 2 shows that the quick sink 115 includes a basin 205. In at least one implementation, the basin 205 is a bowl shaped fixture that can receive and hold water. The basin 205 can be circular, oval, square, rectangular or any other shape according to the preferences of the manufacturer and user. The basin 205 can be made of stainless steel, enamel over steel or cast iron, ceramic, marble, plastic, soapstone, concrete, terrazzo, totianota, wood, stone, copper, glass, granite or any other material suitable for receiving and retaining water.

FIG. 2 also shows that the quick sink 115 includes a faucet 210. In at least one implementation, the faucet 210 can be used to control the release of water or other liquids. I.e., the user can control the amount of water, including the amount of hot water and/or the amount of cold water according to the user's needs. The faucet 210 can provide running water or water to be used in the basin as desired.

FIG. 2 shows that the faucet 210 can include one or more handles 215. In at least one implementation, the one or more handles 215 can be used to control the flow of water through the faucet 210. For example, the faucet 210 can include a first handle 215*a* for controlling the flow of cold water and a second handle 215*b* for controlling the flow of hot water. Additionally or alternatively, the faucet 210 can include a single handle 215 that controls the flow of hot and cold water and the total pressure.

FIG. 2 also shows that the faucet 210 can include a spout 220. In at least one implementation, the spout 220 can direct the flow of water as desired by the user. For example, the spout 220 can be configured to rotate allowing the user to change the location of water flow relative to the basin 205. Additionally or alternatively, the spout 220 can include a hose, allowing the spout to be moved relative to the faucet 210. The spout 220 can include threading, allowing a hose or other attachment to be connected to the spout 220.

FIG. 2 further shows that the quick sink 115 can include a housing 225. In at least one implementation, the housing 225 can contain and protect the other elements of the quick sink 115. The housing 225 can be configured to match the appliance 120 near which the quick sink 115 will be installed. For example, the housing 225, can be configured to match the appearance of a washing machine if the quick sink 115 is to be installed in a laundry room.

In at least one implementation, the housing 225 can be made of a sheet of steel. Additionally or alternatively, the housing 225 can be made of wood and include a counter top near the basin 205 to match the appearance of cabinets and installed sinks. One of skill in the art will appreciate that the housing 225 can be made of any material that provides the desired functionality and appearance.

In at least one implementation, the dimensions of the housing 225 can be configured to match the appliance 120. The outside width of the housing 225 can be between 24 inches and 30 inches. For example, the outside width of the housing 225 can be approximately 27 inches. The outside depth 225 of the housing can be between 22 inches and 29 inches. For example, the outside depth of the housing 225 can be approximately 25.5 inches. The outside height of the housing 225 can be between 30 inches and 42 inches. For example, the outside height of the housing 225 can be approximately 36 inches.

In at least one implementation, the housing 225 can be modified to include other desired features. For example, the housing 225 can include drawers or cabinets to provide a more traditional look and/or additional storage. Additionally or alternatively, the housing 225 can include one or more open sides to allow for the installation of multiple quick sinks 115 next to each other or in conjunction with other appliances.

Figure 3:
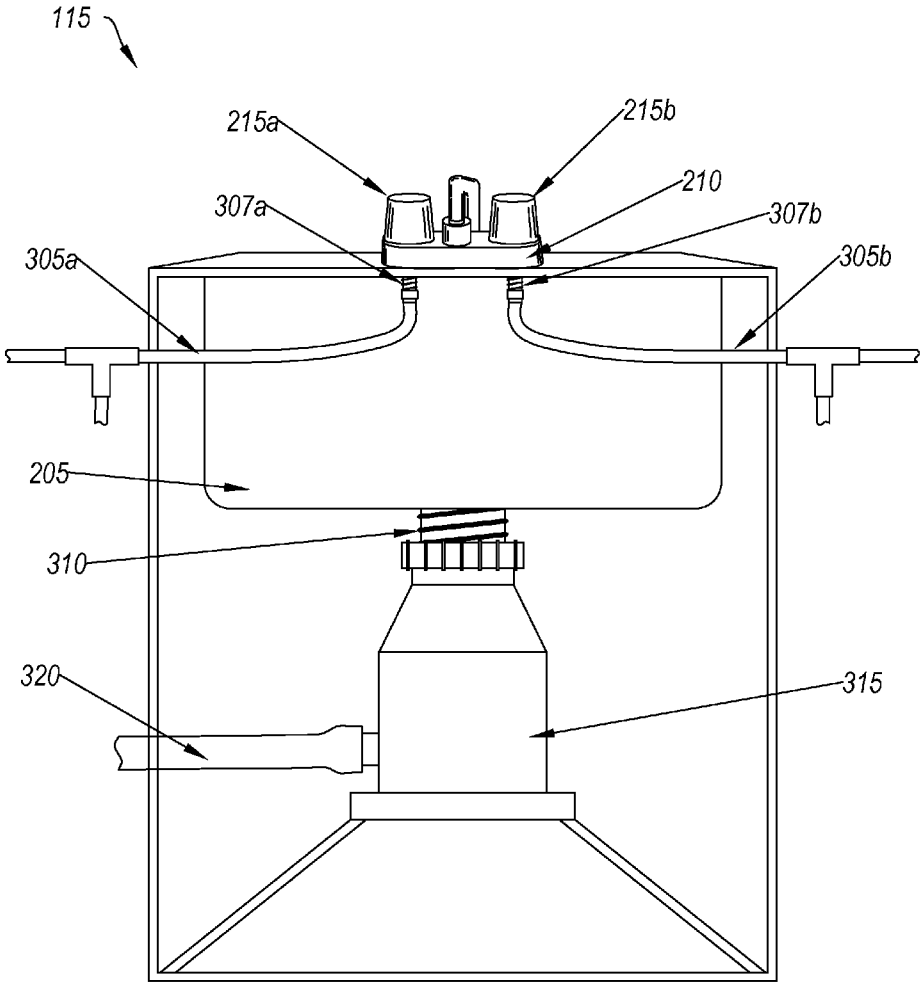
FIG. 3 illustrates an example of a rear view of the quick sink of FIG. 2.

FIG. 3 illustrates an example of a rear view of the quick sink 115 of FIG. 2. In at least one implementation, the connections for the quick sink 115 can be preinstalled in the quick sink 115 to allow for quicker on-site installation. In particular, the quick sink 115 can include connections that allow for installation using existing plumbing fixtures without the need to install additional plumbing fixtures.

FIG. 3 shows that the quick sink 115 includes a first connector 305*a*. In at least one implementation, the first connector 305*a* is configured to connect the cold water input 307*a* of the faucet 210 to a cold water supply. In particular, the first connector 305*a* can include a hose that is configured to connect the cold water supply to the cold water input 307*a* of to the faucet 210, allowing cold water to flow to the faucet 210 through the first connector 305*b* as controlled by the first handle 215*a*.

FIG. 3 also shows that the quick sink 115 includes a second connector 305*b*. In at least one implementation, the second connector 305*b* is configured to connect the hot water input 307*b* of the faucet 210 to a hot water supply. In particular, the second connector 305*b* can include a hose that is configured to connect the hot water supply to the hot water input 307*b* of the faucet 210, allowing hot water to flow to the faucet 210 through the second connector 305*b* as controlled by the second handle 215*b*.

FIG. 3 further shows that the basin 205 can include a drain 310. In at least one implementation, the drain 310 is the primary vessel for removing unwanted water, either to a more useful area, funneled into a receptacle, or run into the sewers or septic system as waste. In at least one implementation, the drain 310 can include a water tight seal in order to prevent any unwanted leaking of water from the basin 205.

FIG. 3 also shows that the quick sink 115 can include a pump 315. In at least one implementation, the pump 315 can be used to remove waste water or other debris from the basin 205. The pump 315 can displace a volume by physical or mechanical action. The pump 315 can include a direct lift pump, a displacement pump, a velocity pump, a buoyancy pump, a gravity pump or any other type of pump.

In at least one implementation, the pump 315 can be used to move waste water to an existing drain near the installation site of the quick sink 115. For example, if the quick sink 115 is installed near a washing machine, the pump 315 can be used to move waste water through a drain line 320 to the washing machine drain. The washing machine drain can include a wall drain. A wall drain is a drain that is located on a wall rather than a floor. In particular, the washing machine drain can include a drain that is partially or completely enclosed within the wall.

In at least one implementation, the pump 315 can be configured to turn on automatically when waste water enters the pump 315. Additionally or alternatively, the pump 315 can include a switch, allowing the user to activate the pump 315 as needed. In at least one implementation, the pump 315 can include a check valve. The check valve can allow flow of waste water away from the quick sink 115 and prevent the return of any waste water toward the quick sink 115. The pump can be plugged into the same outlet used to power the appliance near which the quick sink is being installed. Additionally or alternatively, the pump can be plugged into any nearby power source.

Figure 4:
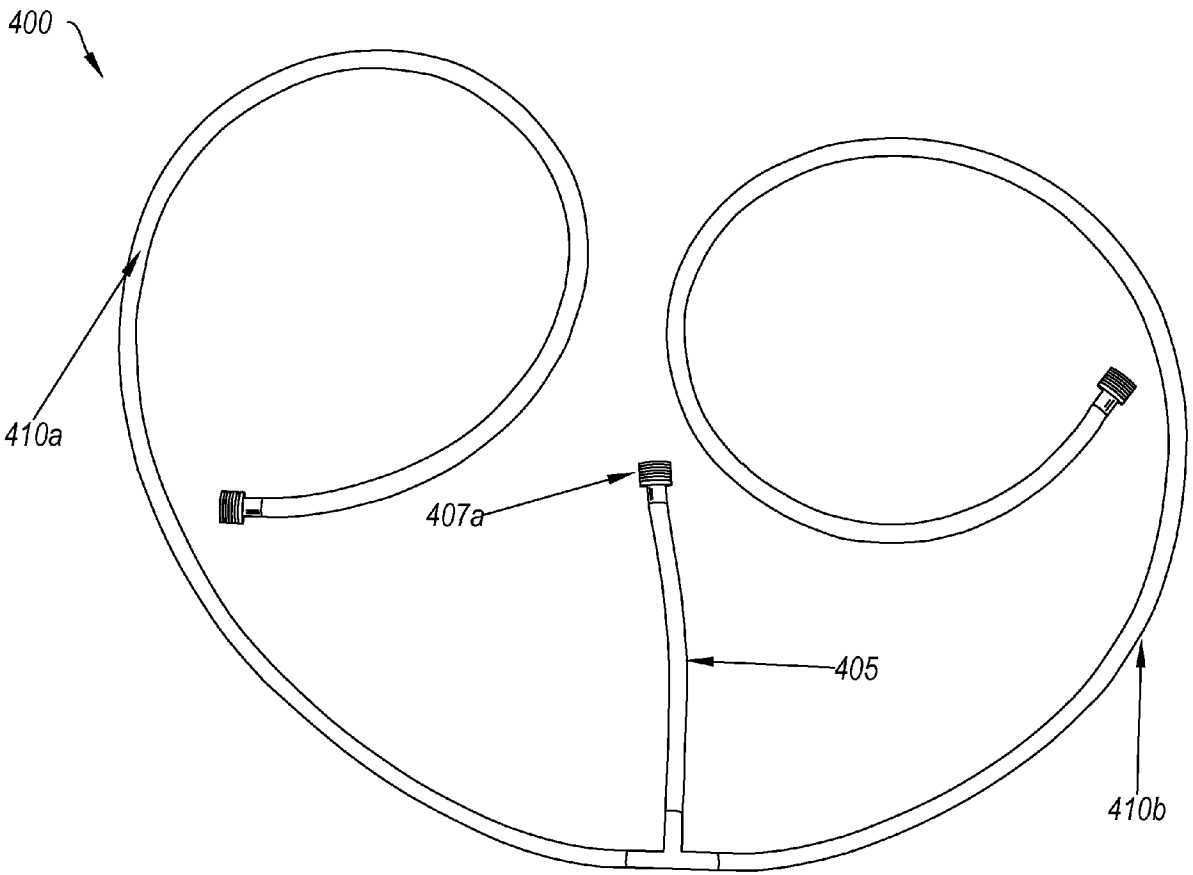
FIG. 4 illustrates an example of a connector that can be used to connect a quick sink to existing plumbing.

FIG. 4 illustrates an example of a connector 400 that can be used to connect a quick sink to existing plumbing. The connector 400 can be the first connector 305*a* or the second connector 305*b* of FIG. 3; however, the connector 400 should not be seen as limiting either the first connector 305*a* or the second connector 305*b* of FIG. 3 and neither the first connector 305*a* nor the second connector 305*b* of FIG. 3 should be seen as limiting the connector 400. In at least one implementation, the connector 400 is substantially T shaped, allowing the flow of water to be divided equally among two different outputs.

FIG. 4 shows that the connector 400 can include an input hose 405. In at least one implementation, the input hose 405 can include a threaded connection 407*a* that allows the input hose to be connected to a hose bib, as described above. The input hose 405 can be made of rubber or any other material that allows for water flow through the input hose 405. In at least one implementation, the input hose 405 can include material that is certified for use with potable water.

The input hose 405 can be of sufficient length to allow for easy connection to the water supply without making other connections difficult. For example, the input hose 405 can be between 10 and 14 inches in length. In particular, the input hose 405 can be approximately 12 inches in length.

FIG. 4 further shows that the connector 400 can include a first output hose 410*a* and a second output hose 410*b* (collectively "output hoses 410"). The first output hose 410*a* can be configured to connect the input hose to a quick sink. Additionally or alternatively, the second output hose 410*b* can be configured to connect the input hose 405 to a pre-installed appliance 120. In at least one implementation, the output hoses 410 can be made from the same material as the input hose 405.

The output hoses 410 can be of sufficient length to allow for connection of both the quick sink and the pre-installed appliance 120 without the need for other connections. For example, the output hoses 410 can be between 5 feet and 7 feet in length. In particular, the output hoses 410 can be 6 feet in length.

Figure 5:
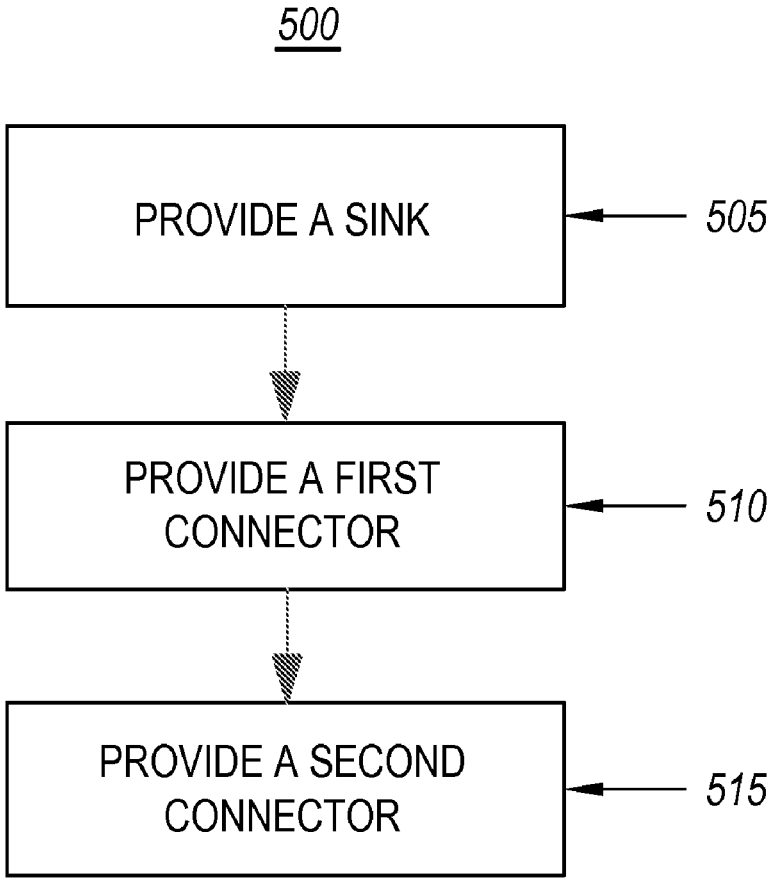
FIG. 5 is a flow chart illustrating a method of manufacturing a quick sink.

FIG. 5 is a flow chart illustrating a method 500 of manufacturing a quick sink. One of skill in the art will appreciate that the method 500 can be used to produce the quick sink 115 of FIG. 1; however, the method 500 can be used to produce a quick sink other than the quick sink 115 of FIG. 1.

FIG. 5 shows that the method 500 can include providing a sink 505. In at least one implementation, the sink includes a basin. In at least one implementation, the basin is a bowl shaped fixture that can receive and hold water. The basin can be circular, oval, square, rectangular or any other shape according to the preferences of the manufacturer and user. The basin can be made of stainless steel, enamel over steel or cast iron, ceramic, marble, plastic, soapstone, concrete, terrazzo, totianota, wood, stone, copper, glass, granite or any other material suitable for receiving and retaining water.

Additionally or alternatively, the sink can include a faucet. In at least one implementation, the faucet can be used to control the release of water or other liquids. I.e., the user can control the amount of water, including the amount of hot water and/or the amount of cold water according to the user's needs. The faucet can provide running water or water to be used in the basin as desired.

In at least one implementation, the sink can include a cold water input and a hot water input. In at least one implementation, the cold water input is configured to receive cold water to be carried the faucet and output where it is available to the user. In at least one implementation, the hot water input is configured to receive hot water to be carried the faucet and output where it is available to the user.

Additionally or alternatively, the sink can include one or more handles. In at least one implementation, the one or more handles can be used to control the flow of water through the faucet. For example, the faucet can include a first handle for controlling the flow of cold water and a second handle for controlling the flow of hot water. Additionally or alternatively, the faucet can include a single handle that controls the flow of hot and cold water and the total pressure.

Additionally or alternatively, the faucet can include a spout. In at least one implementation, the spout can direct the flow of water as desired by the user. For example, the spout can be configured to rotate allowing the user to change the location of water flow relative to the basin. Additionally or alternatively, the spout can include a hose, allowing the spout to be moved relative to the faucet. The spout can include threading, allowing a hose or other attachment to be connected to the spout.

Additionally or alternatively, the sink can include a drain. In at least one implementation, the drain is the primary vessel for removing unwanted water, either to a more useful area, funneled into a receptacle, or run into the sewers or septic system as waste. In at least one implementation, the drain can include a water tight seal in order to prevent any unwanted leaking of water from the basin.

FIG. 5 shows that the method 500 can also include providing a first connector 510. In at least one implementation, the first connector is configured to connect the cold water input of the faucet to a cold water supply. In particular, the first connector can include a hose that is configured to connect the cold water supply to the cold water input of the faucet, allowing cold water to flow to the faucet through the first connector as controlled by the first handle.

In at least one implementation, the first connector can include an input hose. The input hose can include a threaded connection that allows the input hose to be connected to a hose bib, as described above. The input hose can be made of rubber or any other material that allows for water flow through the input hose. In at least one implementation, the input hose can include material that is certified for use with potable water.

The input hose can be of sufficient length to allow for easy connection to the water supply without making other connections difficult. For example, the input hose can be between 10 and 14 inches in length. In particular, the input hose can be approximately 12 inches in length.

Additionally or alternatively, the first connector can include a first output hose and a second output hose. The first output hose can be configured to connect the input hose to a quick sink. Additionally or alternatively, the second output hose can be configured to connect the input hose to a pre-installed appliance. In at least one implementation, the output hoses can be made from the same material as the input hose.

The output hoses can be of sufficient length to allow for connection of both the quick sink and the pre-installed appliance without the need for other connections. For example, the output hoses can be between 5 feet and 7 feet in length. In particular, the output hoses can be 6 feet in length.

FIG. 5 shows that the method 500 can also include providing a second connector 515. In at least one implementation, the second connector is configured to connect the hot water input of the faucet to a hot water supply. In particular, the second connector can include a hose that is configured to connect to the hot water supply to the hot water input of the faucet, allowing hot water to flow to the faucet through the second connector as controlled by the second handle.

In at least one implementation, the second connector can include an input hose. The input hose can include a threaded connection that allows the input hose to be connected to a hose bib, as described above. The input hose can be made of rubber or any other material that allows for water flow through the input hose. In at least one implementation, the input hose can include material that is certified for use with potable water.

The input hose can be of sufficient length to allow for easy connection to the water supply without making other connections difficult. For example, the input hose can be between 10 and 14 inches in length. In particular, the input hose can be approximately 12 inches in length.

Additionally or alternatively, the second connector can include a first output hose and a second output hose. The first output hose can be configured to connect the input hose to a quick sink. Additionally or alternatively, the second output hose can be configured to connect the input hose to a pre-installed appliance. In at least one implementation, the output hoses can be made from the same material as the input hose.

The output hoses can be of sufficient length to allow for connection of both the quick sink and the pre-installed appliance without the need for other connections. For example, the output hoses can be between 5 feet and 7 feet in length. In particular, the output hoses can be 6 feet in length.

In at least one implementation, the method 500 can also include providing a housing. In at least one implementation, the housing can contain and protect the other elements of the quick sink. The housing can be configured to match the appliance near which the quick sink will be installed. For example, the housing, can be configured to match the appearance of a washing machine if the quick sink is to be installed in a laundry room.

In at least one implementation, the housing can be made of a sheet of steel. Additionally or alternatively, the housing can be made of wood and include counter top near the basin to match the appearance of cabinets and installed sinks. One of skill in the art will appreciate that the housing can be made of any material that provides the desired functionality and appearance.

In at least one implementation, the dimensions of the housing can be configured to match a nearby appliance. The outside width of the housing can be between 24 inches and 30 inches. For example, the outside width of the housing can be approximately 27 inches. The outside depth of the housing can be between 22 inches and 29 inches. For example, the outside depth of the housing can be approximately 25.5 inches. The outside height of the housing can be between 30 inches and 42 inches. For example, the outside height of the housing can be approximately 36 inches.

In at least one implementation, the housing can be modified to include other desired features. For example, the housing can include drawers or cabinets to provide a more traditional look and/or additional storage. Additionally or alternatively, the housing can include one or more open sides to allow for the installation of multiple quick sinks next to each other or in conjunction with other appliances.

Additionally or alternatively, the method can also include providing a pump. In at least one implementation, the pump can be used to remove waste water or other debris from the basin. The pump can displace a volume by physical or mechanical action. The pump can include a direct lift pump, a displacement pump, a velocity pump, a buoyancy pump, a gravity pump or any other type of pump.

In at least one implementation, the pump can be used to move waste water to an existing drain near the installation site of the quick sink. For example, if the quick sink is installed near a washing machine, the pump can be used to move waste water through a drain line to the washing machine drain. The washing machine drain can include a wall drain. A wall drain is a drain that is located on a wall rather than a floor. In particular, the washing machine drain can include a drain that is partially or completely enclosed within the wall.

In at least one implementation, the pump can be configured to turn on automatically when waste water enters the pump. Additionally or alternatively, the pump can include a switch, allowing the user to activate the pump as needed. In at least one implementation, the pump can include a check valve. The check valve can allow flow of waste water away from the quick sink and prevent the return of any waste water toward the quick sink. The pump can be plugged into the same outlet used to power the appliance near which the quick sink is being installed. Additionally or alternatively, the pump can be plugged into any nearby power source.

One skilled in the art will appreciate that, for this and other processes and methods disclosed herein, the functions performed in the processes and methods may be implemented in differing order. Furthermore, the outlined steps and operations are only provided as examples, and some of the steps and operations may be optional, combined into fewer steps and operations, or expanded into additional steps and operations without detracting from the essence of the disclosed embodiments.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A quick sink system, the quick sink system comprising:
a sink, wherein the sink includes:
a faucet, wherein the faucet includes a water input for receiving water;
a basin, wherein the basin is configured to retain water; and
a drain, wherein the drain is configured to remove water from the basin; and
a connector, wherein the connector includes:
an input hose, wherein the input hose is configured to connect to a water supply;
a first output hose, wherein the first output hose is configured to connect to the water input; and
a second output hose, wherein the second output hose is configured to be connected to a water connection of a washing machine.

2. The system of claim 1, further comprising:
a pump, wherein the pump is configured to pump water from the drain to an external location.

3. The system of claim 2, wherein the elevation of the external location is higher than the drain of the sink.

4. The system of claim 1, wherein the faucet includes a second water input.

5. The system of claim 4, further comprising a second connector, wherein the second connector further comprises:
an input hose, wherein the input hose is configured to connect to a second water supply;
a first output hose, wherein the first output hose is configured to connect to the second water input; and
a second output hose, wherein the second output hose is configured to be connected to a second water connection of the washing machine.

6. The system of claim 1, wherein the input hose of the connector is between 10 inches and 14 inches long.

7. The system of claim 6, wherein the input hose of the connector is approximately 12 inches long.

8. The system of claim 1, wherein the first output hose and the second output hose of the connector are each between 5 feet and 7 feet long.

9. The system of claim 8, wherein the first output hose and the second output hose of the connector are each approximately 6 feet long.

10. A method for producing a quick sink system, the method comprising:
providing a sink, wherein the sink includes:
a faucet, wherein the faucet includes:
a cold water input for receiving cold water; and
a hot water input for receiving hot water;
a basin, wherein the basin is configured to retain water; and
a drain, wherein the drain is configured to remove water from the basin;
connecting a first connector to the cold water input, wherein:
the first connector is configured to connect the cold water input to a cold water supply; and
includes:
an input hose, wherein the input hose is configured to connect to a cold water supply;
a first output hose, wherein the first output hose is configured to connect to the cold water input; and
a second output hose, wherein the second output hose is configured to be connected to a cold water connection of a washing machine; and
connecting a second connector to the hot water input, wherein the second connector is configured to connect the hot water input to a hot water supply.

11. The method of claim 10, wherein the method further comprises:
providing a housing, wherein the housing is configured to substantially enclose the sink, the first connector and the second connector.

12. The method of claim 11, wherein the outside width of the housing is between 24 inches and 30 inches.

13. The method of claim 12, wherein the outside width of the housing is approximately 27 inches.

14. The method of claim 11, wherein the outside depth of the housing is between 22 inches and 29 inches.

15. The method of claim 14, wherein the outside depth of the housing is approximately 25.5 inches.

16. The method of claim 11, wherein the outside height of the housing is between 30 inches and 42 inches.

17. The method of claim 12, wherein the outside height of the housing is approximately 36 inches.

18. A quick sink system, wherein the quick sink system is configured to allow for the installation of a sink using existing plumbing connections connected to a washing machine, the quick sink system comprising:
a sink, wherein the sink includes:
a faucet, wherein the faucet includes:
a cold water input for receiving cold water; and
a hot water input for receiving hot water;
a basin, wherein the basin is configured to retain water; and a drain, wherein the drain is configured to remove water from the basin;

a first connector, wherein the first connector includes:

an input hose, wherein the input hose is configured to connect to a cold water supply;

a first output hose, wherein the first output hose is configured to connect to the cold water input; and a second output hose, wherein the second output hose is configured to be connected to a cold water connection of a washing machine; and a second connector, wherein the second connector includes:

a second input hose, wherein the input hose is configured to connect to a hot water supply;

a third output hose, wherein the first output hose is configured to connect to the hot water input; and a fourth output hose, wherein the second output hose is configured to be connected to a hot water connection of the washing machine;

a pump, wherein the pump is configured to pump water from the drain to a wall drain used by the washing machine;

a housing, wherein the housing is configured to substantially enclose a portion of the basin, the drain, a portion of the first connector, a portion of the second connector and the pump.

19. The system of claim 18, wherein:

the first connector is substantially T shaped;

the first output hose is:

approximately perpendicular to the first input hose; and the second output hose is:

approximately perpendicular to the first input hose; antiparallel to the first output hose.

* * * * *